US007025670B1

(12) United States Patent
Robinson

(10) Patent No.: US 7,025,670 B1
(45) Date of Patent: Apr. 11, 2006

(54) ROTATABLE VENT

(75) Inventor: Larry Dwight Robinson, Taylorsville, MS (US)

(73) Assignee: Solar Group, Inc., Taylorsville, MS (US)

( * ) Notice: Subject to any disclaimer, the term of this patent is extended or adjusted under 35 U.S.C. 154(b) by 234 days.

(21) Appl. No.: 10/436,023

(22) Filed: May 12, 2003

(51) Int. Cl.
*F23L 17/10* (2006.01)

(52) U.S. Cl. ..... 454/19; 454/18

(58) Field of Classification Search ..... 454/18, 454/19

See application file for complete search history.

(56) References Cited

U.S. PATENT DOCUMENTS

| | | | | | |
|---|---|---|---|---|---|
| 535,276 | A | * | 3/1895 | Doerge | 454/18 |
| 2,013,244 | A | * | 9/1935 | La Vergne | 454/15 |
| 3,066,596 | A | * | 12/1962 | Gray et al. | 454/18 |
| 4,641,571 | A | | 2/1987 | Anderson et al. | |
| 5,779,539 | A | | 7/1998 | Kolt | |
| 6,352,473 | B1 | | 3/2002 | Clark | |
| 6,582,291 | B1 | | 6/2003 | Clark | |

FOREIGN PATENT DOCUMENTS

| | | | |
|---|---|---|---|
| GB | 6189 | * | 1/1905 |
| GB | 236001 | * | 7/1925 |

* cited by examiner

*Primary Examiner*—Harold Joyce
(74) *Attorney, Agent, or Firm*—Arnold B. Silverman; Eckert Seamans Cherin & Mellott, LLC

(57) ABSTRACT

A wind powered rotatable vent includes an annular rotatable louvered panel axially rotatable about a shaft and an impeller disposed in spaced underlying relationship with respect to the rotatable louvered panel and rotatably secured to the shaft. A fixed collar underlies at least a portion of the rotatable louvered panel and a brace which is rotatably secured to the shaft has first arms secured to an upper portion of the rotatable louvered panel and second arms secured to a lower portion thereof. The collar and rotatable louvered panel define a passageway for flow of air therethrough. The rotatable louvered panel is structured to rotate responsive to wind impinging thereon and responsive to air flowing upwardly through the impeller in the passageway.

27 Claims, 9 Drawing Sheets

ROTATABLE VENT

BACKGROUND OF THE INVENTION

1. Field of the Invention

The present invention relates to a rotatable vent having an annular rotatable louvered panel and an underlying rotatable impeller both of which are rotatably positioned with respect to a fixed shaft. More specifically, it relates to such a louvered panel which cooperates with a fixed collar to define an air flow passageway while resisting undesired entry of precipitation into the building to which it is secured.

2. Description of the Prior Art

It has been known to provide various types of turbine and other vents which are secured to roof portions or other portions of a building for purposes of efficiently exhausting air from the building and discharging the same to the surrounding environment.

In some such structures a motor or solar energy source of power is employed to energize a rotating fan element which has suitable blades for exhausting air from a region. The rotating fan which is fixedly secured to a shaft and exhausted through a cover member may be provided with a series of louvers.

It has also been known to provide turbines which are freely rotatable by wind currents to rotate an exhaust assembly and draw air up through a collar and outwardly through a passageway. See, for example, U.S. Pat. No. 4,641,571.

U.S. Pat. No. 5,779,539 discloses a static venting system which had a plurality of nested louvered members providing a static venting system for discharge of air therethrough.

One of the disadvantages of prior art systems is the need to have a source of energy to power the same or the need to rely on air flow through a static system.

Another disadvantage of prior art systems has been the large generally dome shaped aesthetically unpleasant appearance of the louvered element which projects a substantial distance above the roof or other structure.

A further disadvantage of prior systems involves collar members which are so closely placed to the rotating louver members that under certain conditions undesired contact therebetween produced an unpleasant noise during relative rotation.

Also lacking in prior art systems are structures of suitable strength as to withstand extended use under varying weather conditions, including wind loading.

In spite of the foregoing there remains a very real and substantial need for an improved rotatable vent which is devoid of prior inadequacies.

SUMMARY OF THE INVENTION

The present invention has met the hereinbefore described needs.

The invention provides a rotatable vent having an annular rotatable louvered panel and an underlying spaced impeller both of which are rotatably secured to a fixed shaft. A fixed collar having at least a portion underlying the rotatable louvered panel is provided and a brace rotatably secured to the shaft has first arms secured to an upper portion of the rotatable louvered panel and second arms secured to a lower portion of the rotatable louvered panel.

The louvers are preferably generally vertically oriented and the impeller blades are slanted so as to enhance the efficiency of exhaust when the impeller is rotated responsive to the louver being rotated by external wind to establish flow of air upwardly through the passageway defined between by the fixed collar and the rotatable louvered panel.

A suitable cap is provided over a top louver cover so as to resist undesired entry of precipitation and airborne foreign matter into the passageway other than through open louvers. Preferred weather shields are provided in the lower cap member to further resist such undesired entry of precipitation and foreign matter.

It is an object of the present invention to provide an efficient rotating vent which rotates responsive to exterior wind without requiring another source of power or due to rising warm air within the building, such as in an attic or both.

It is a further object of the present invention to provide such a rotating vent which avoids undesired noises present in certain prior art systems.

It is yet another object of the present invention to provide a low profile rotating vent that which is suitable for positioning on roofs or other building parts.

It is yet another object of the present invention to provide such construction which is structurally reinforced so as to resist undesired failure of the rotating vent.

It is yet another object of the present invention to provide such rotating vents which are structured to efficiently and quietly remove heat and moisture from the interior of a roof structure.

It is a further object of the present invention to provide a durable, economical and aesthetically pleasing rotating vent.

It is yet another object of the invention to provide a wind powered, fan assisted rotating vent wherein the source of power to operate the vent will be external with the airstream moving across the exterior of the vent to rotate the fan and establish upward flow of air in order to exhaust the same through the vent.

These and other objects of the invention will be more fully understood from the following detailed description of the invention on reference to the illustrations appended hereto.

BRIEF DESCRIPTION OF THE DRAWINGS

FIG. 6(*b*) is a schematic illustration showing the angles of the louver elements with only a few being illustrated.

DESCRIPTION OF THE PREFERRED EMBODIMENT

Figure 1:
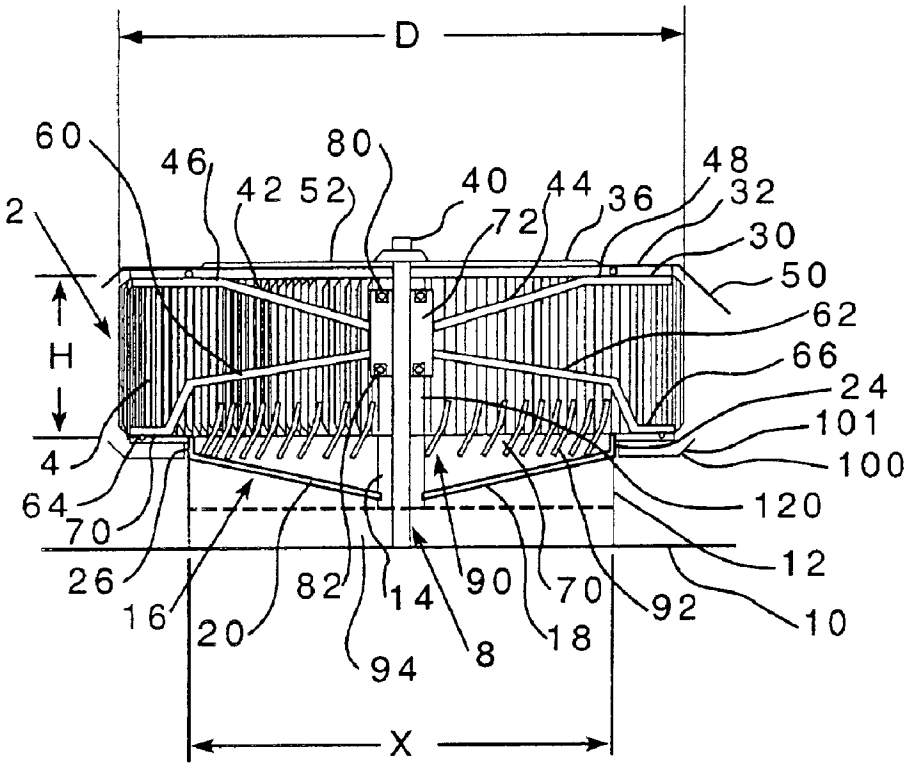
FIG. 1 is a partially schematic cross-sectional illustration of a form of rotatable vent of the present invention.

Referring in greater detail to FIG. 1, there is shown a form of rotatable vent of the present invention. In this embodiment a rotatable louvered panel 2 is of generally annular configuration and has a plurality of generally vertically oriented louver elements positioned circumferentially therearound to permit radial flow of air thereby. A fixed shaft 8 has its lower end secured to a base 10 and is surrounded by a fixed collar 12 which is secured to shaft 8 by means of a hub 14 which is fixedly secured to the shaft 8. A brace member 16 has upwardly extending arms such as 18 and 20 which terminate in flanges 24, 26, respectively, which are secured to an interior surface of an upper portion of the fixed collar 12. The upper portion of the rotatable louvered panel has an overlying cover 30 which cooperates with a weather cap 32 which is secured to shaft 8 by rivets (not shown) or by other suitable fasteners adjacent shaft end 40. A plurality of first bracing arms such as 42, 44, for example, extend upwardly and outwardly and have respective flange members 46, 48 secured to panel cover 30. The weathercap 32 has an annular angularly downwardly projecting annular flange 50 in order to resist undesired entry of precipitation and foreign matter into the space 52 between the weathercap 32 and the panel top cover 30. A plurality of second arms such as 60, 62 extend generally downwardly and outwardly and terminate, respectively, in flanges 64, 66 which are secured to a bottom panel cover 70. The inner portions of the arms such as 44, 46, 60, 62 are connected to a hub 72 which, in the form shown, is rotatably connected to shaft 8 by bearings 80, 82.

Disposed in spaced underlying relationship with respect to the rotatable louvered panel is an impeller or fan 90 which has a plurality of individual blade members 92 which are angularly offset with respect to the vertical. Warm air within the building may cause rotation of impeller 90. The inner portion of the rotatable louvered panel 2 and a fixed collar 12 define a generally vertical passageway 94 for flow of air therethrough.

Figure 2:
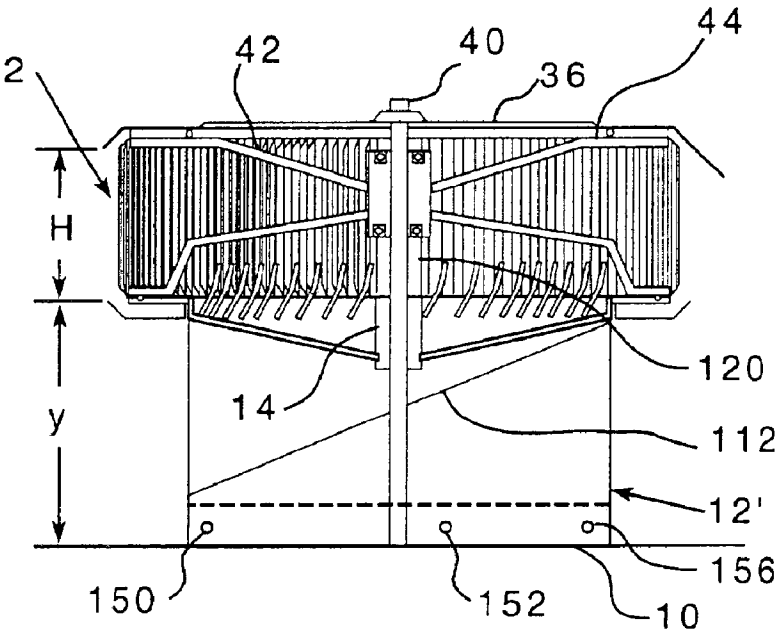
FIG. 2 is a partially schematic cross-sectional illustration of a modified form of rotatable vent of the present invention.
Figure 3:
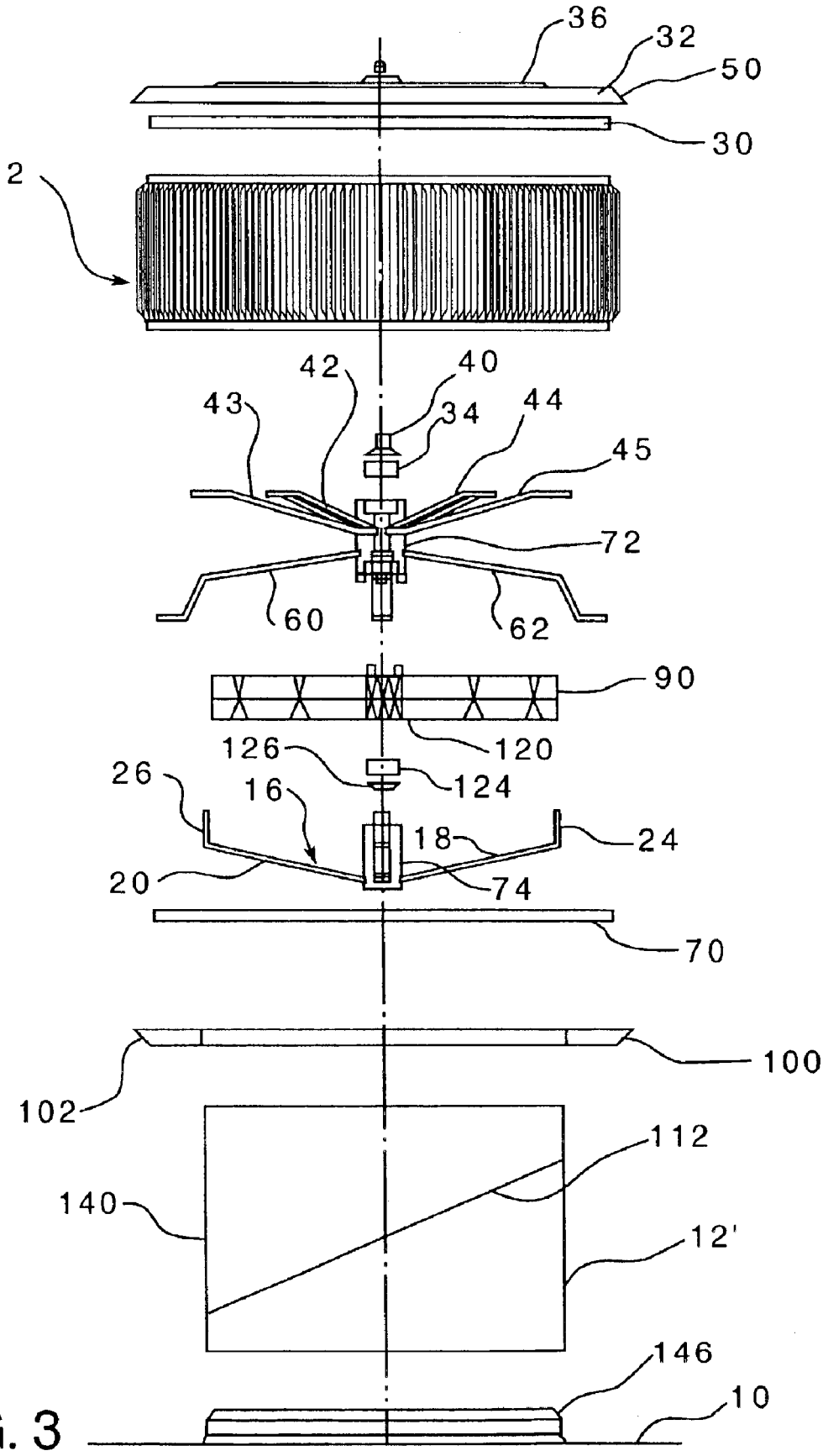
FIG. 3 is an exploded view of the rotatable vent of FIG. 2.

In the form shown in FIGS. 1 through 3 the louvered panel 2 has louvers which are preferably generally parallel to each other and oriented in the same direction. The individual louvers of louvered panel 2 as shown in FIGS. 1 and 3 will have an angular orientation such that the left edge will be closer to the geometric center of the panel than the right edge. This results in the louver being angled forwardly from left to right in the figures. Wind impinging on the exterior of the louvered panel 2 will establish clockwise rotation of the louvered panel which in cooperation with the impeller 90 blade 92 orientation will urge air upwardly through passageway 94 and out of the building. If desired, the cooperating louvers and impeller blades may both be provided in the reverse orientation to provide the same effect with rotation of the louvered panel in a counterclockwise direction.

Air moving upwardly through passageway 94 will impinge on the underside of top cover 36 and will flow outward to exit the vent. It should be noted that lower weathershield 100 is of annular configuration and terminates in a generally upwardly and outwardly extending flange 101 so as to resist undesired entry of precipitation and foreign matter into the passageway 94. The weathershield 100 may be integrally formed with bottom panel cover 20, if desired.

One of the advantages of the present invention is the elimination of some of the prior art large upwardly projecting, aesthetically unappealing spherical louvered shapes. The present invention provides a low profile. It is preferred that the rotating louvered panel have an external diameter D which is about 2 to 5 times the height H of the rotatable louvered panel and, most preferably, about 2.5 to 3.75 times the height H. For example, the diameter D may be about 15 to 18 inches and the height H may be about 4 to 6 inches. It is also preferred that the external diameter D of the rotatable louvered panel 2 be about 1.25 to 1.75 times the exterior diameter X of the fixed collar 12.

It will be appreciated that the rotatable vent of the present invention may have components made of any structurally suitable durable material which will permit economical manufacture and efficient functioning. In general, it is preferred that the parts exposed to the weather be made of a suitable metal, such as aluminum. The rotating louvered panel 2 and cap 36 and fixed collar 12, for example, may be made of aluminum. Other components which are disposed on the interior, such as the brace member 16, arms 43, 44, 46, 48 and impeller 92, may be made of a suitable resinous plastic material.

In installing the vent on a roof or in an exterior wall or in other desired location, a hole of suitable diameter which, generally, will be the same as diameter X of fixed collar 12 will be made in the building and the base 10 will be secured to the region surrounding the opening as by screws or other fasteners. Suitable flashing may be provided thereover.

Referring to FIG. 2, there is shown a modified form of the invention. In this embodiment the collar 12' is modified so as to be adjustable depending upon the orientation of the building portion to which it would be secured. For example, either the embodiment of FIG. 1 or 2 could be employed readily on a flat roof structure or a structure wherein a flat base on the collar such as base 10 on collar 12' could be employed. On the other hand, the collar 12' may be provided with greater height Y than the collar 12 shown in FIG. 1 for certain uses and could be provided with a line 112 for severance where it would be desired to have the bottom of the collar 12' angularly oriented.

Referring to FIG. 3, an exploded version of the embodiments of FIGS. 1 and 2 is shown, with the collar 12' of FIG. 2 being employed. As shown, the rotatable louvered panel 2 has a top louver panel cover 30 and an overlying cap 36 having an underlying weather cap 32 which terminates in a downwardly directed annular flange 50. If desired, cover 30 and cap 36 may be provided as a unitary structure.

The bottom panel cover 70 is preferably annular and has an underlying weathershield 100 which terminates in a generally upwardly and outwardly directed flange 102. The weathershield 100 may be integrally formed with cover 70. The brace member has a hub 72 which is rotatably secured to the shaft 8 and bearings (not shown in this view) and has a plurality of upwardly and generally outwardly projecting first arms 42, 44, 43, 45 which are secured to the top louvered panel cover 30 by any suitable means such as suitable mechanical fasteners. A plurality of second arms 60, 62 are secured to the hub 72 at a lower level than the first arms 42, 44, 43, 45 and are preferably of an equal number. The underlying impeller 90 which may be molded from a suitable resinous plastic material such as an engineering grade polymer having the desired strength and molded surface finish. It is rotatably secured to the shaft 8 by means of hub 120 (FIGS. 1 and 2). The cap member 39 and top 40 secure the assembly to the bracing member. Underlying the impeller is a bushing member 124 which is operatively associated with a push nut 126. A lower bracing member 16 has a plurality of generally upwardly and outwardly projecting arms such as 18, 20 which terminate in upper flanges 24, 26 respectively, and may be secured to the inner surface of annular wall 140 of collars 12 or 12'.

The base 10 preferably has a radial extent greater than diameter D of the rotatable louvered panel 2 and has an upwardly projecting portion 146 which is adapted to fit within the lower end of collar 12 or 12' with suitable mechanical fasteners such as rivets 150, 152, 156 as shown, for example, in FIG. 2, fixedly securing the collars 12, 12' to the base 10.

Figure 4:
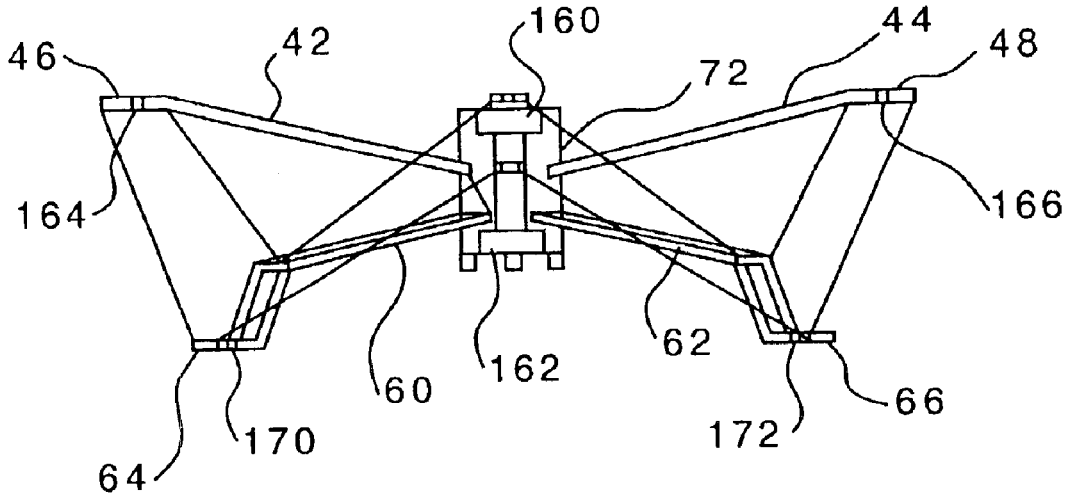
FIG. 4 is a partially schematic elevational view showing the bracing members of a form of rotatable vent of the present invention.
Figure 5:
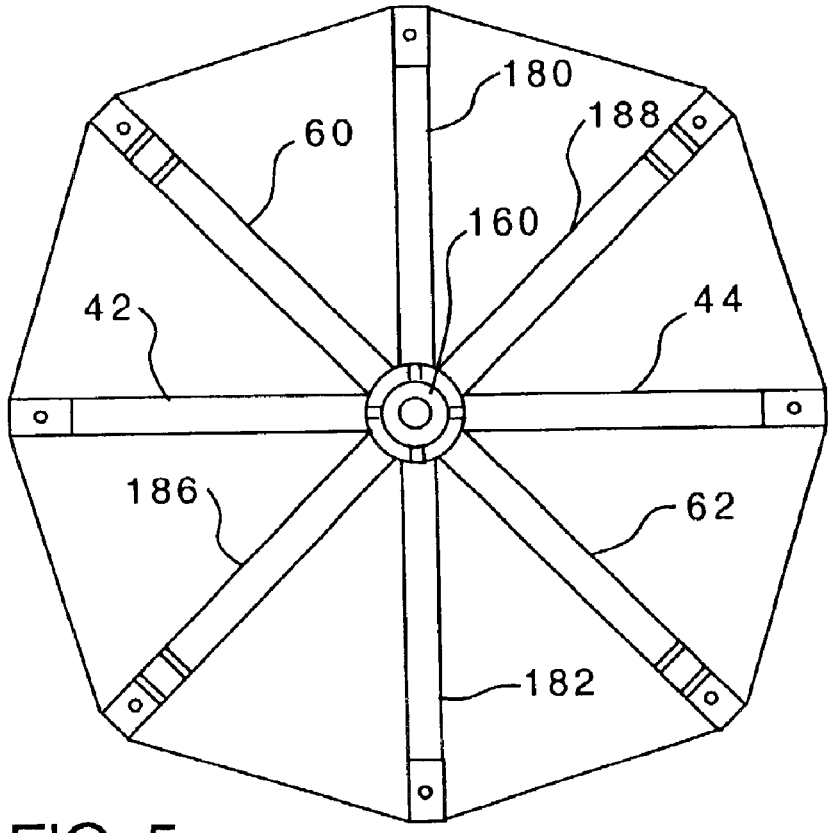
FIG. 5 is a top plan view of the bracing members of FIG. 4.

FIGS. 4 and 5 show details of the brace provided on the interior of rotatable louvered panel 2. As shown, the hub 72 has upper and lower bearing receiving recesses 160, 162. The upward flanges have openings 164, 166 for passage of mechanical fasteners therethrough in order to secure the upper brace arms such as 44, 46 to the top louver panel cover 30. Similarly, arms 60, 62 terminate in flanges 64, 66 which have openings 170, 172 for passage of mechanical fasteners therethrough and into bottom louver panel cover 70.

As shown in the plan view of FIG. 5 in the form illustrated a brace has, four upper arms 42, 44, 180, 182 and four lower arms 60, 62, 186, 188.

Figure 6B:
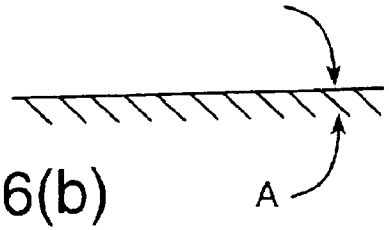
FIG. 6(*a*) is a fragmented elevational view of a portion of the rotatable louvered vent of the present invention.
Figure 6A:
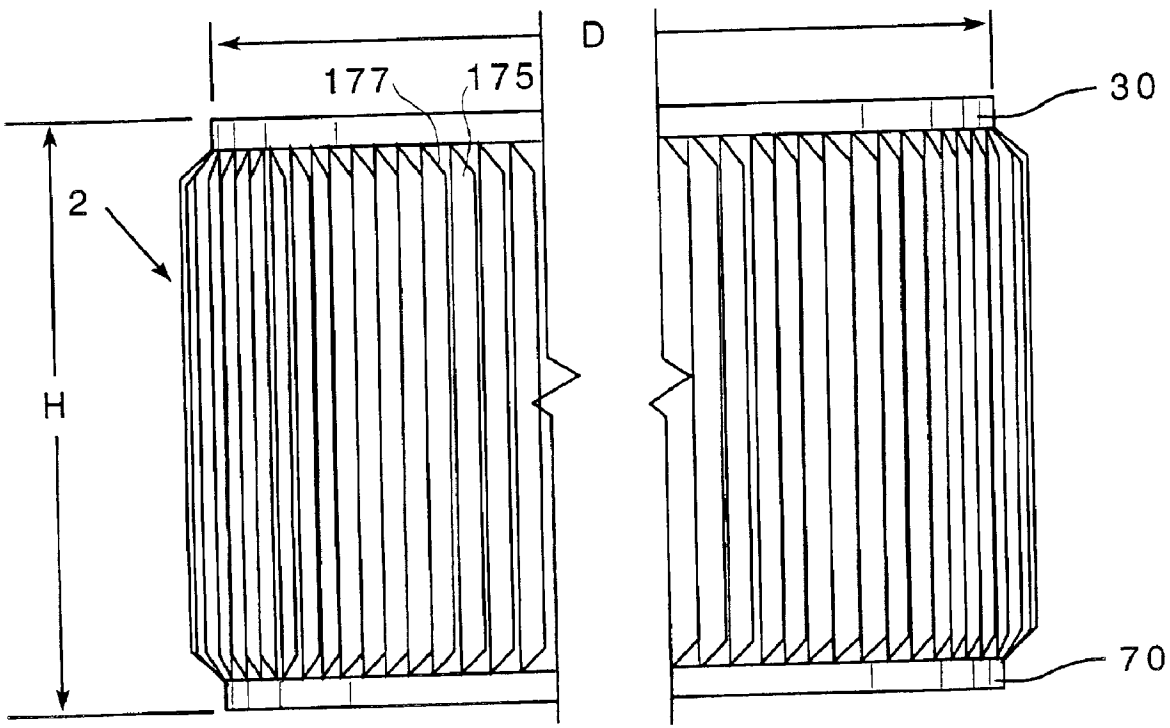

Referring to FIGS. 6(*a*) and (*b*), the rotatable louvered panel 2 has a plurality of outwardly open louvers such as 175, 177 which, as shown in FIG. 6(*b*), have an included angle A which, preferably, would be about 20 to 45 degrees so as to permit efficient use of wind impinging on the same to establish axial rotation of the rotatable louvered member 2. For certain sizes, it is preferred that the louvered member have a diameter D of about 15 to 18 inches and a height H of about 4 to 6 inches with the low profile being a preferred feature of the invention.

Figure 9:
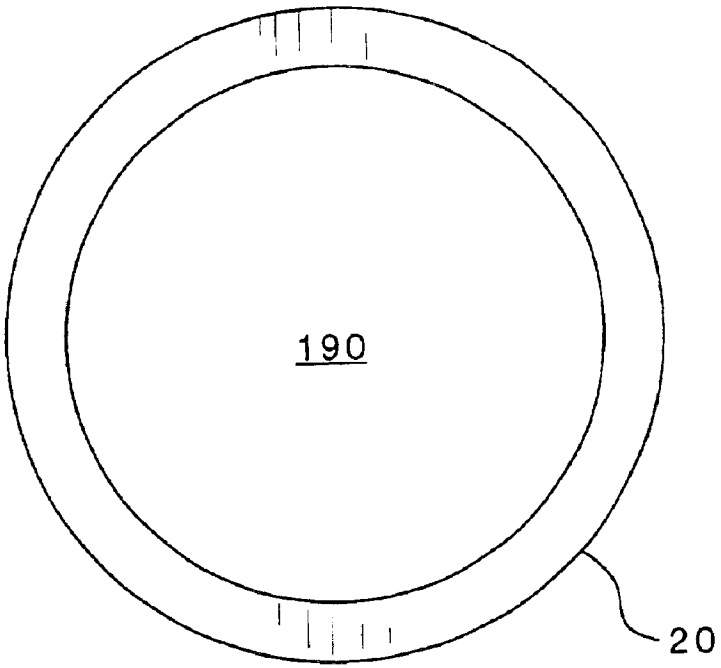
FIGS. 9 and 10 are, respectively, a plan view and elevational view of a lower cover of the present invention.
Figure 10:
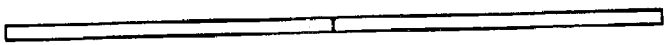
Figure 7:
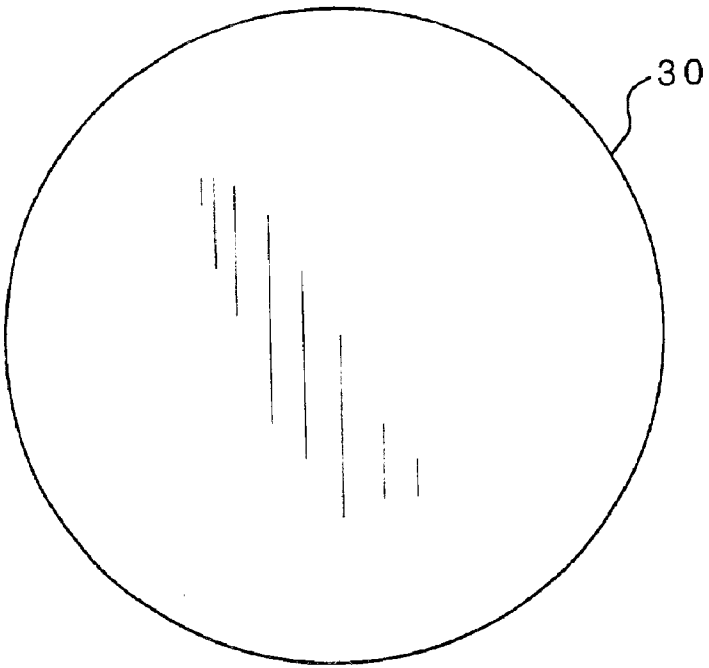
FIGS. 7 and 8 are, respectively, a plan and elevational view of the upper cover and brace connector of the rotating vent of the present invention.
Figure 8:
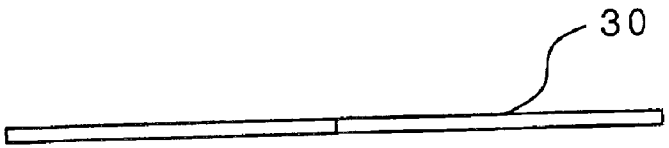

The upper cover 30, as shown in FIGS. 7 and 8, has a generally circular periphery and is solid. The brace arms such as 42, 44, 180, 182 are secured to the undersurface of the same. As shown in FIGS. 9 and 10, the lower cover 70 is annular and has a central opening 190 through which air may flow. Integral or separate peripheral weathershields may be provided for both covers 30, 70.

Figure 11:
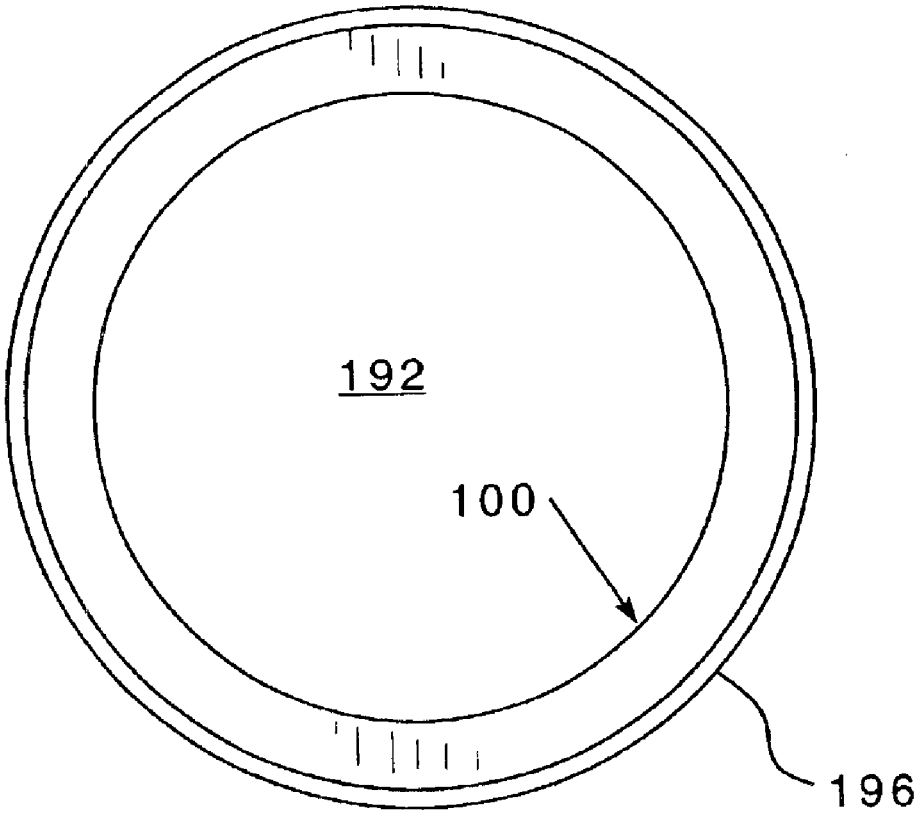
FIGS. 11 and 12 are, respectively, a top plan and elevational view of a weathershield of a rotatable vent of the present invention.
Figure 12:
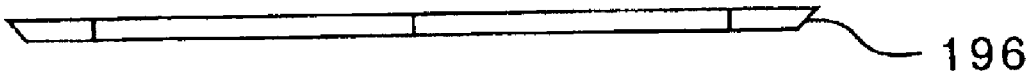

As shown in FIGS. 11 and 12, the weatherproofing lower cover 100 is annular and defines a central opening 192 with an upwardly and outwardly projecting edge 196 so as to resist undesired entry of moisture and foreign material into the passageway.

Figure 14:
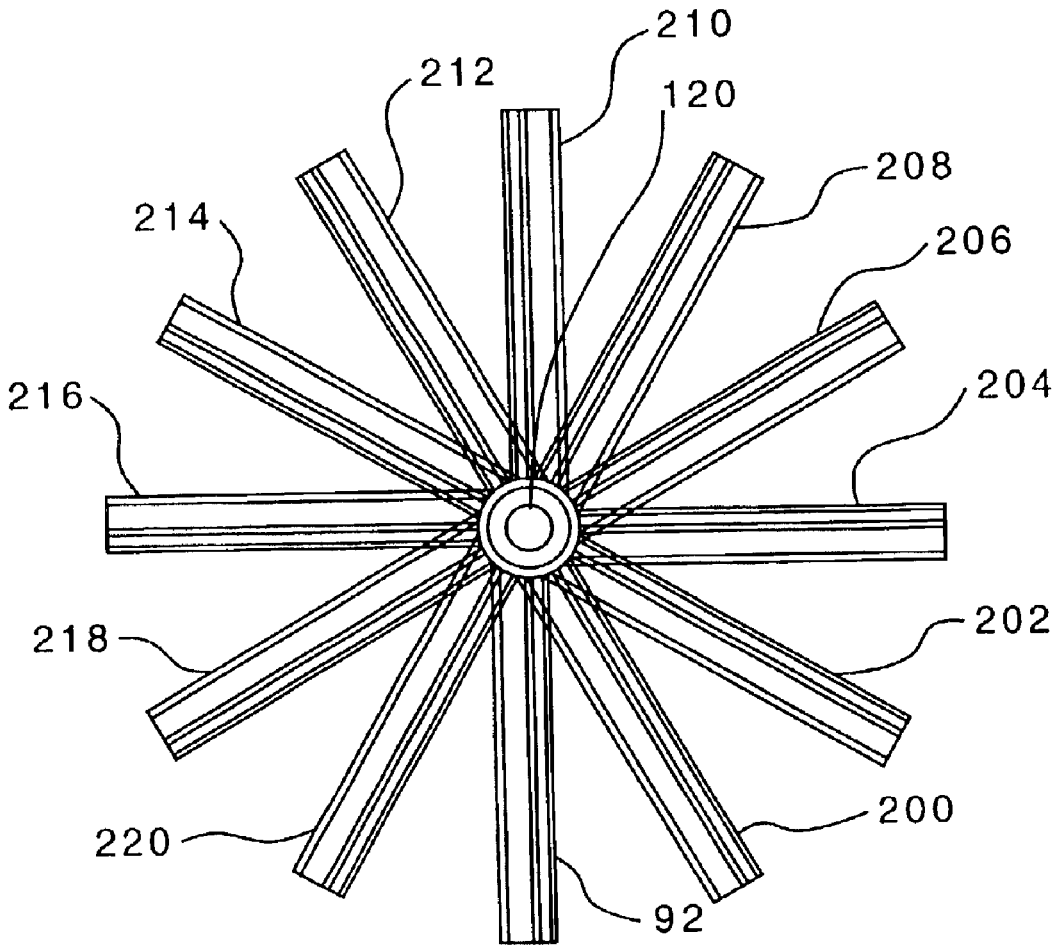
FIG. 14 is a top plan view of the impeller of FIG. 13.
Figure 13:
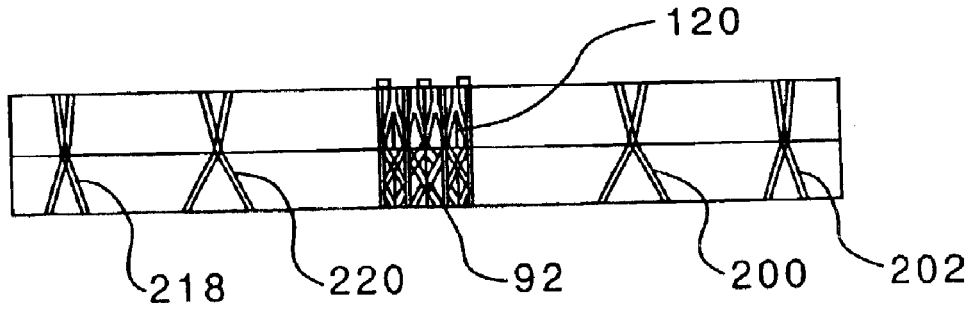
FIG. 13 is a cross-sectional view of an impeller of the present invention.

As shown in FIGS. 13 and 14, the impeller has the hub 120 and a plurality of axially biased fan blades 92, 200, 202, 204, 206, 208, 210, 212, 214, 216, 218, 222.

Figure 15:
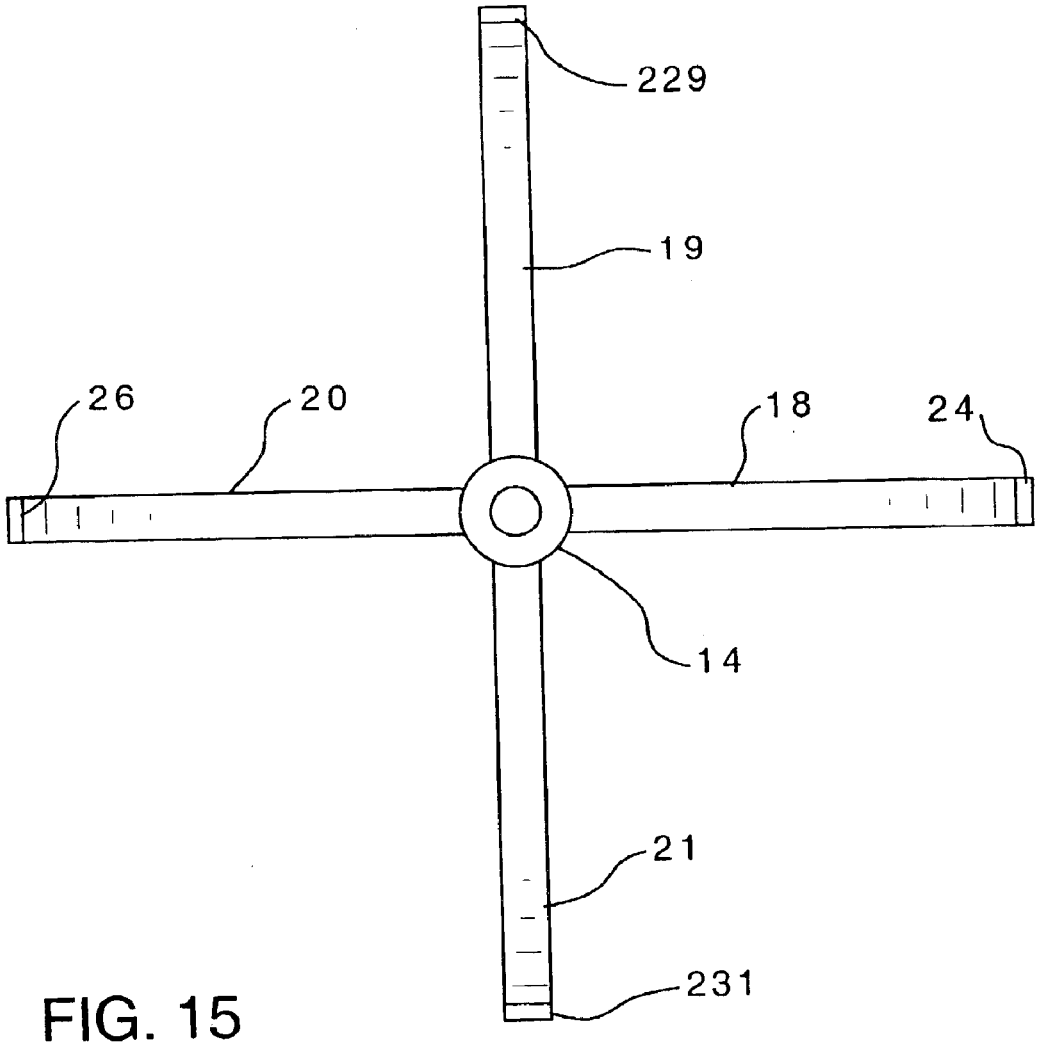
FIG. 15 is a top plan view of the fixed collar brace of the present invention.
Figure 16:
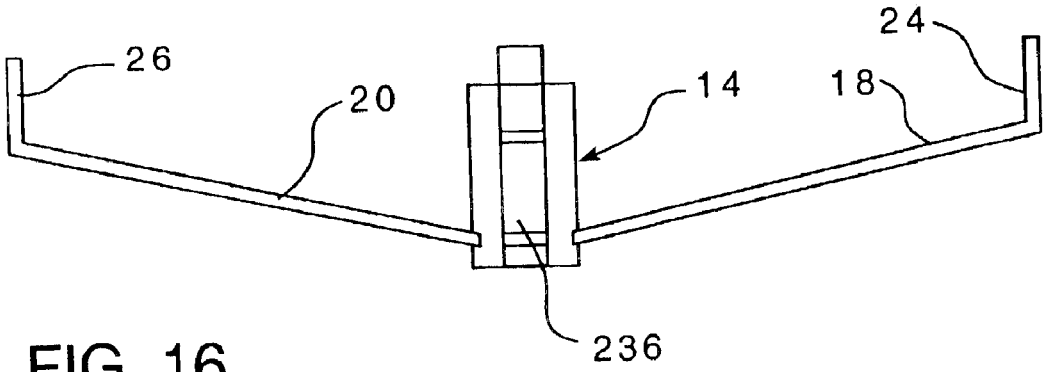
FIG. 16 is an elevational view of the collar brace of the present invention.

FIGS. 15 and 16 show the bracing element 14 for supporting the fixed collar 12, 12'. In the form shown it has four arms 18, 19, 20, 21 which extend upwardly and terminate in flanges 24, 26, respectively, as well as flanges 229 and 231 on arms 19, 20, respectively. These serve to provide a method of securement by suitable mechanical fasteners (not shown) to the interior of the fixed collars 12, 12'. Shaft 8 is secured within opening 236.

Figure 17:
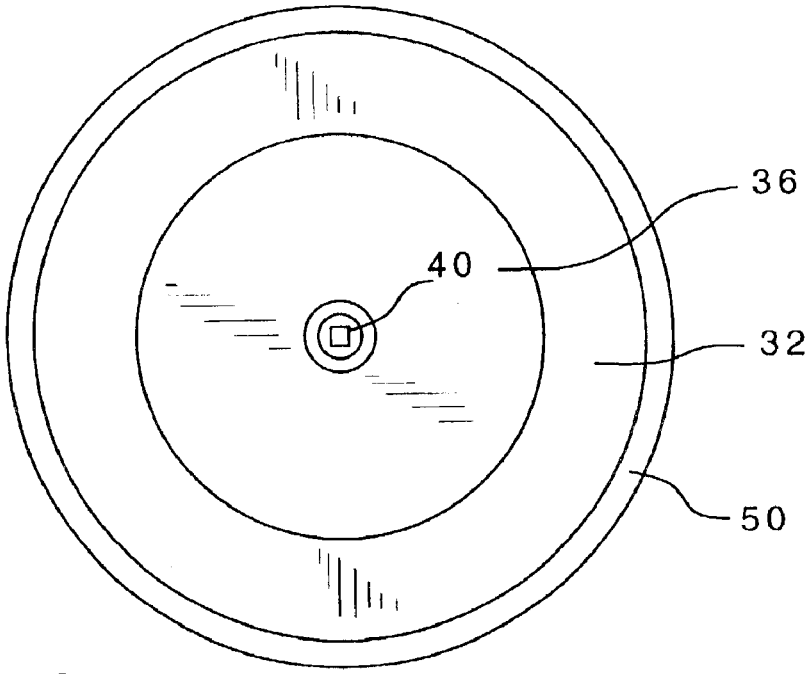
FIG. 17 is a top plan view of a top cover of the present invention.
Figure 18:
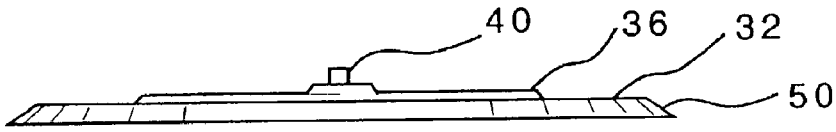
FIG. 18 is an elevational view of the top cover of FIG. 17.

FIGS. 17 and 18 show details of the top cover 36 with the underlying weathershield 32 and its downwardly and outwardly projecting edge 50. If desired, the weathershield 32 may be integrally formed with top cover 36.

Figure 19:
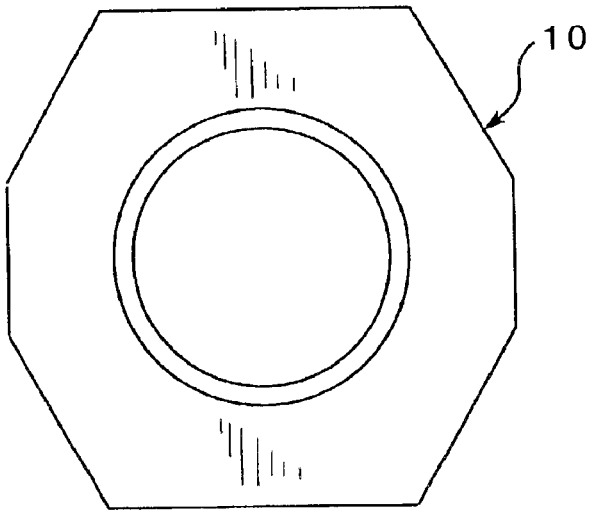
FIG. 19 is a top plan view of a base member of the present invention.
Figure 20:
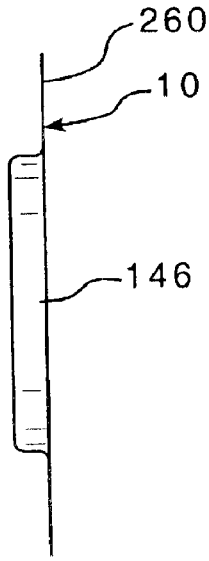
FIG. 20 is a right-side elevational view of the base of FIG. 19.

As shown in FIGS. 19 and 20, the base member 10 has an outer portion 260 which will be employed to secure the vent to the building adjacent to the building opening and has an upwardly projecting portion 146 which will extend into the lower portion of fixed collar 121, 12' and be secured thereto by mechanical fasteners such as rivets or screws 150, 152, 156 (FIG. 2).

It will be appreciated, therefore, that the present invention provides an improved wind or heat powered, low profile efficient rotatable ventilator which eliminates numerous problems of the prior art. The structure is economical to manufacture, easy to install, relatively silent in operation and does not require an independent source of power such as motors or solar panels. It is structurally reinforced so as to provide for efficient functioning and durability.

Whereas particular embodiments of the invention have been described herein for purposes of illustration it will be evident to those skilled in the art that numerous variations of the details may be made without departing from the invention as set forth in the appended claims.

What is claimed is:

1. A rotatable vent comprising an annular rotatable louvered panel, an elongated shaft extending axially through said rotatable louvered panel, said rotatable louvered panel being rotatably secured to said shaft, an impeller rotatably secured to said shaft and disposed in spaced underlying relationship with respect to said rotatable louvered panel, a fixed collar having at least a portion underlying said rotatable louvered panel, a brace rotatably secured to said shaft and having a plurality of arms secured to said rotatable louvered panel, and said plurality of arms having first arms secured to an upper portion of said rotatable louvered panel and second arms secured to a lower portion of said rotatable louvered panel.

2. The rotatable vent of claim 1 including said rotatable louvered panel having a top louver cover and a bottom louver cover.

3. The rotatable vent of claim 2 including said first arms extending generally upwardly and being secured to said top louver cover.

4. The rotatable vent of claim 3 including said second arms extending generally downwardly and being secured to said bottom louver cover.

5. The rotatable vent of claim 2 including said top louver cover being generally annular, and said bottom louver cover being generally annular.

6. The rotatable vent of claim 2 including a cap overlying said top louver cover.

7. The rotatable vent of claim 6 including said cap being disposed in overlying relationship with respect to said top louver cover.

8. The rotatable vent of claim 7 including said cap having a peripheral edge which extends generally outwardly and downwardly to resist entry of precipitation into said rotatable louvered panel through said top louver cover.

9. The rotatable vent of claim 1 including said impeller having a hub and a radially outwardly spaced ring and a plurality of blades extending generally radially therebetween.

10. The rotatable vent of claim 9 including said blades being angularly offset from a perpendicular orientation with respect to said hub.

11. The rotatable vent of claim 10 including said collar having a brace including a hub fixedly secured to said shaft and a plurality of arms extending toward and secured to said collar.

12. The rotatable vent of claim 7 including an annular weathershield disposed under said bottom louver cover and extending radially outwardly therebeyond.

13. The rotatable vent of claim 12 including a base underlying said collar.

14. The rotatable vent of claim 13 including said elongated shaft being fixedly secured to said base.

15. The rotatable vent of claim 2 including said top louver cover having an integrally formed weathershield.

16. The rotatable vent of claim 2 including said bottom louver cover having an integrally formed weathershield.

17. The rotatable vent of claim 1 including said rotatable louvered panel being structured to rotate axially responsive to external application of wind or flow of air through said passageway.

18. The rotatable vent of claim 1 including said impeller being structured to urge air upwardly through said passageway and into said rotatable louvered panel.

19. The rotatable vent of claim 18 including said rotatable louvered panel having an external diameter to height ratio of about 2 to 5.

20. The rotatable vent of claim 10 including said collar being fixedly secured to said shaft.

21. The rotatable vent of claim 1 including said louvers being composed of metal.

22. The rotatable vent of claim 1 including said impeller being composed of a resinous plastic material.

23. The rotatable vent of claim 1 including said vent being structured to provide static ventilation when said rotatable louvered panel and said impeller are not rotating.

24. The rotatable vent of claim 1 including said vent being a roof ventilator.

25. The rotatable vent of claim 1 including said rotatable louvered panel having a diameter greater than its height.

26. The rotatable vent of claim 1 including said rotatable louvered panel having an external diameter greater than the external diameter of said collar.

27. A rotatable vent comprising an annular rotatable louvered panel, an elongated shaft extending axially through said rotatable louvered panel, said rotatable louvered panel being rotatably secured to said shaft, an impeller rotatably secured to said shaft and disposed in spaced underlying relationship with respect to said rotatable louvered panel, a fixed collar having at least a portion underlying said rotatable louvered panel, a brace rotatably secured to said shaft and having a plurality of arms secured to said rotatable louvered panel, said rotatable louvered panel and said collar cooperating to define an air flow passageway, and said louvers being generally vertically oriented on said rotatable louver panel, whereby air moving through said passageway can exit through said louvers.

* * * * *

UNITED STATES PATENT AND TRADEMARK OFFICE

CERTIFICATE OF CORRECTION

PATENT NO. : 7,025,670 B1
APPLICATION NO. : 10/436023
DATED : April 11, 2006
INVENTOR(S) : Larry Dwight Robinson It is certified that error appears in the above-identified patent and that said Letters Patent is hereby corrected as shown below:

Column 6, line 13, "121" should be changed to --12--.

Signed and Sealed this

Seventh Day of November, 2006

JON W. DUDAS
*Director of the United States Patent and Trademark Office*